US007879233B2

(12) United States Patent
Shaw et al.

(10) Patent No.: US 7,879,233 B2
(45) Date of Patent: Feb. 1, 2011

(54) DRAIN GRATE FILTER ASSEMBLY WITH COMPRESSIBLE ANCHORS

(76) Inventors: Mark D. Shaw, 196 S. Roscoe Blvd., Ponte Vedra Beach, FL (US) 32092; J. Tad Heyman, 659 Ocean Blvd., Atlantic Beach, FL (US) 32259; Phyl Kimball, 4607 Wadham Ln., Jacksonville, FL (US) 32210

( * ) Notice: Subject to any disclaimer, the term of this patent is extended or adjusted under 35 U.S.C. 154(b) by 1077 days.

(21) Appl. No.: 11/642,285

(22) Filed: Dec. 20, 2006

(65) Prior Publication Data

US 2008/0149544 A1 Jun. 26, 2008

(51) Int. Cl.
*E03F 5/06* (2006.01)

(52) U.S. Cl. ..... 210/164; 404/4

(58) Field of Classification Search ..... None
See application file for complete search history.

(56) References Cited

U.S. PATENT DOCUMENTS 1,024,059 A * 4/1912 Brintnall ..... 49/33
1,329,405 A * 2/1920 Hinton ..... 210/163
1,941,589 A * 1/1934 Wellons ..... 292/95
1,981,358 A 11/1934 Hernandez
3,474,625 A 10/1969 Draper et al.
4,080,984 A * 3/1978 Klein ..... 137/371
4,371,288 A 2/1983 Borca et al.
4,567,697 A * 2/1986 Hahne ..... 52/19
4,838,732 A 6/1989 Clark et al.
4,871,451 A * 10/1989 Piskula ..... 210/164
4,973,191 A * 11/1990 Dannhauser ..... 404/25
4,988,234 A 1/1991 Henkel et al.
5,051,022 A * 9/1991 Bowman ..... 404/26
5,056,955 A * 10/1991 Spiess et al. ..... 404/25
5,071,177 A * 12/1991 Spiess et al. ..... 292/91
5,090,713 A * 2/1992 Johnson ..... 277/648
5,236,281 A 8/1993 Middleton
5,375,940 A * 12/1994 Kobayashi ..... 404/2
5,394,657 A 3/1995 Peterson
5,403,474 A 4/1995 Emery
5,405,539 A 4/1995 Schneider
5,460,867 A 10/1995 Magnuson et al.
5,632,888 A 5/1997 Chinn et al.
5,643,445 A 7/1997 Billias et al.
5,702,595 A * 12/1997 Mossburg, Jr. ..... 210/163
5,732,512 A * 3/1998 Ueno et al. ..... 52/19
5,779,393 A * 7/1998 Gunter ..... 405/121
5,849,198 A * 12/1998 Sharpless ..... 210/693
5,954,952 A 9/1999 Stawser, Sr.
6,017,166 A * 1/2000 Mossburg, Jr. ..... 404/5
6,214,216 B1 4/2001 Isaacson
6,231,267 B1 * 5/2001 Pearl ..... 404/25
6,254,770 B1 7/2001 Remon
6,274,036 B1 8/2001 Ellis
6,338,168 B1 1/2002 Valentine
6,530,722 B1 3/2003 Shaw et al.
6,764,261 B1 * 7/2004 Stadler ..... 411/342
6,811,708 B2 11/2004 Shaw et al.

(Continued)

*Primary Examiner*—Robert James Popovics
(74) *Attorney, Agent, or Firm*—Thomas C. Saitta

(57) ABSTRACT

A drain grate filter assembly having a filter sheet member, wedging anchors and mechanical fasteners, whereby the assembly is connected to a drain grate by inserting wedging anchors into the apertures of the grate, placing the filter sheet member atop the grate and inserting fasteners through the filter sheet member and into the wedging anchors.

4 Claims, 2 Drawing Sheets

U.S. PATENT DOCUMENTS 6,869,526 B2 * 3/2005 Sharpless ..... 210/164
7,128,495 B1 * 10/2006 Lill et al. ..... 404/4
7,201,533 B2 * 4/2007 DeGreef ..... 404/25
7,347,070 B1 * 3/2008 Spector ..... 70/169
7,404,690 B2 * 7/2008 Lukasik et al. ..... 404/36
7,455,474 B2 * 11/2008 Tievant et al. ..... 404/25
7,611,304 B2 * 11/2009 Lill et al. ..... 404/4
7,662,280 B1 * 2/2010 Cooney ..... 210/164
7,780,372 B2 * 8/2010 Fattori et al. ..... 404/2
2003/0047497 A1 3/2003 Harris et al.
2003/0053862 A1 * 3/2003 Shaw et al. ..... 405/40
2003/0147693 A1 * 8/2003 Knak et al. ..... 404/4
2005/0051467 A1 * 3/2005 Yehuda ..... 210/156
2007/0086856 A1 * 4/2007 Lill et al. ..... 404/4
2007/0237580 A1 * 10/2007 Sulak et al. ..... 404/25
2008/0006568 A1 * 1/2008 Moody et al. ..... 210/164
2008/0145150 A1 * 6/2008 Shaw et al. ..... 405/52
2008/0149544 A1 * 6/2008 Shaw et al. ..... 210/163

* cited by examiner

FIG. 2
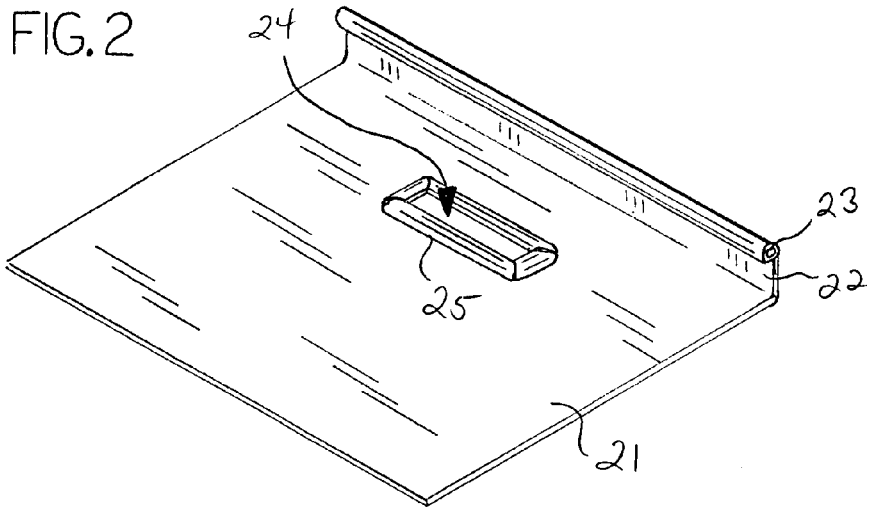
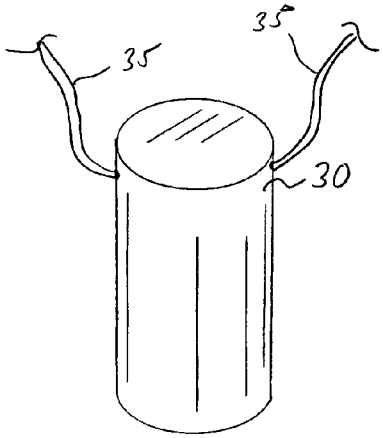
FIG. 3
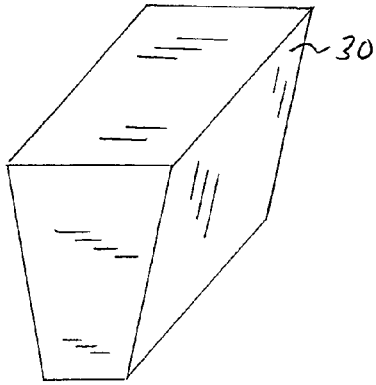
FIG. 4
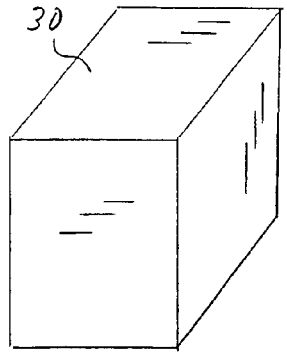
FIG. 5

DRAIN GRATE FILTER ASSEMBLY WITH COMPRESSIBLE ANCHORS

BACKGROUND OF THE INVENTION

This invention relates generally to the field of filtering devices used to cover drain openings to preclude ingress of undesirable particulate matter, such as sediment, debris, etc. More particularly, the invention relates to such filters used in conjunction with floor or ground mounted drains, such as for example storm drains found in roadways and paved areas, that have apertured grates covering the opening and preventing entry of relatively large objects.

It is often desirable or necessary to be able to quickly and easily cover storm drains and the like to prevent the ingress of undesirable particulate matter resulting from sudden storm events or the like. The drains comprise pipes or chambers that extend below ground and are connected to storm sewer systems, and the drains are covered by apertured grates positioned at the liquid ingress level, the apertures usually comprising numerous holes or elongated slots. It is known to provide filtering devices for the drain grates having a liquid permeable sheet member, either by anchoring the sheet member beneath the grate, by providing the sheet member in the form of an envelope that encases the grate member, or by securing the sheet member to the grate by ropes, straps or the like. These means and methods suffer from a common problem in that use of the drain grate cover requires handling the grate itself, which is time consuming and may lead to injuries due to the heaviness of the grate.

It is an object of this invention to provide a drain grate filter assembly that may be fastened securely to the grate quickly and easily without having to remove, lift and replace the grate. It is a further object to provide such a drain grate filter assembly that can be used in conjunction with any grate regardless of the positions, shapes or types of apertures found therein, such that the grate filter is generally universal in application. It is a further object to provide such a drain grate filter assembly in alternative embodiments such that the filter assembly is also applicable to storm drains disposed at curb inlets. It is a further object to provide such a drain grate filter assembly in another alternative embodiment wherein the filter assembly comprises an overflow opening surrounded by a berm such that water may pass thorough the opening in the event the filter media becomes liquid impermeable due to the accumulation of particulate matter.

SUMMARY OF THE INVENTION

The invention is in general a drain grate filter assembly used in conjunction with floor or ground level drains having surface grates, the filter comprising a liquid permeable sheet member composed of a durable, flexible fabric, felt or perforated material of sufficient size to extend to or beyond the perimeter of the grate. The drain grate filter assembly further comprises compressible or flexible wedging anchors which are easily inserted into some of the apertures of the storm grate by forcing the anchors downward into the apertures without moving the grate, the compressibility or flexibility of the anchors providing sufficient lateral pressure against the sides of the apertures to secure the anchors in the apertures. The anchors are composed of a material, such as a closed cell polymer foam, able to receive and retain mechanical fasteners, such as pins or staples, that are inserted through the sheet member at the location of each anchor. The anchors may be formed in solid geometrical shapes such as cylinders, rectangles, wedges, cones, etc., or may be formed as a spring clip, having for example V- or U-shapes with leg portions that are pressed together during insertion. The mechanical fasteners may be provided with heads or other expansive flanges that rest against the upper surface of the sheet member to prevent the fasteners from being pulled through the sheet member, or separate backer members may be disposed atop the sheet member, with the fasteners being inserted through the backer member, the sheet member and into the anchors.

To filter liquids passing through the drain grate, the anchors are pressed into the apertures so that their upper surfaces are flush with the upper surface of the grate. The filter sheet member is then laid over the grate, and the sheet member may be trimmed to reduce the overall size if needed. The backer members, if needed, are then positioned on top of the sheet member above the anchors and the fasteners are inserted through the sheet member and into the anchors.

Alternative embodiments of the drain grate filter assembly include the provision of an extended filter flap member with mounting means to position the flap member across the opening of a curb inlet adjacent the grate to filter liquid flowing into the curb inlet. In another alternative embodiment, the filter sheet member may be provided with an interiorly-disposed relief opening that is surrounded by a berm member, such that if the filter becomes clogged due to particulate accumulation, or if a sudden storm event presents an excessive quantity of water, the excess may pass over the berm, through the relief opening and into the drain system to preclude flooding of the area.

BRIEF DESCRIPTION OF THE DRAWINGS

FIG. 2 is a view of an alternative embodiment of the filter sheet member of the invention, showing a curb inlet flap filter member and a water relief opening surrounded by a berm member.

FIGS. 3 though 5 illustrate possible alternative structures for the wedging anchors.

DETAILED DESCRIPTION OF THE INVENTION

With reference to the drawings, the invention will now be described in detail with regard for the best mode and the preferred embodiment. In general, the invention is a drain grate filter assembly for precluding entry of particulate matter, such as silt or debris, carried by liquid entering the drain grate.

Figure 1:
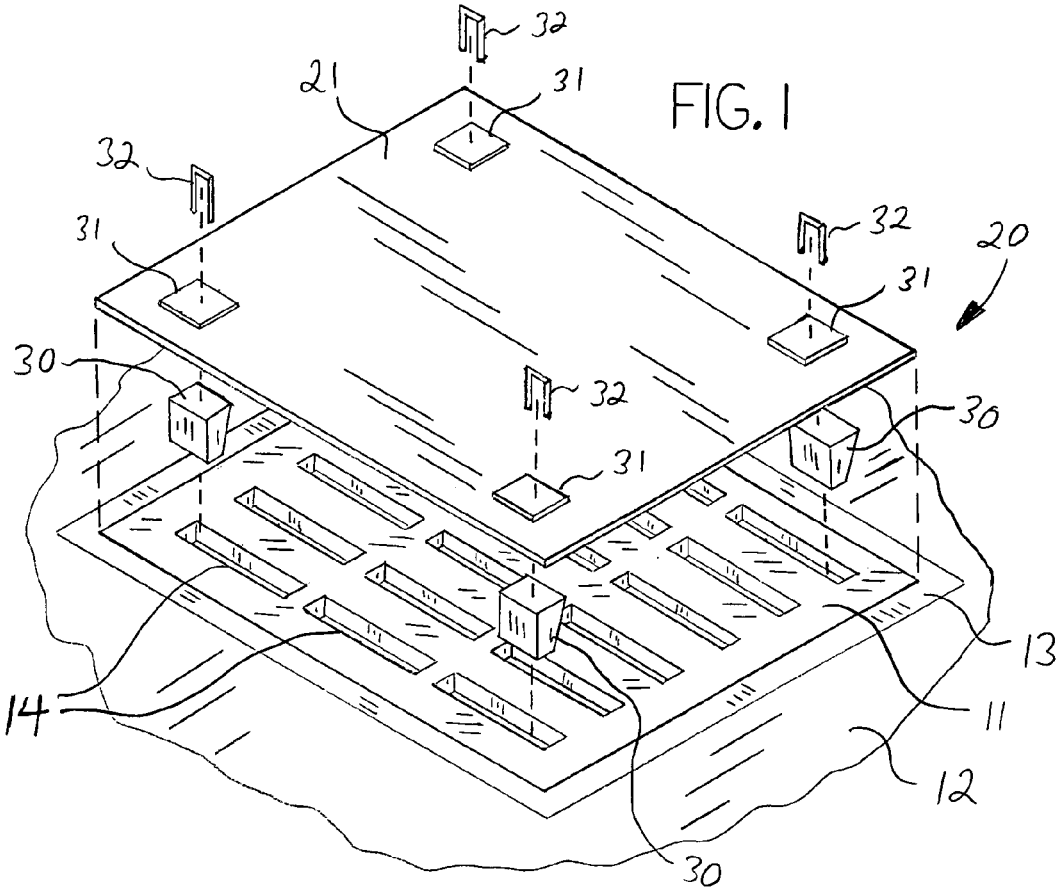
FIG. 1 is an expanded view showing the drain grate filter assembly in relation to a storm drain grate.

As seen in FIG. 1, the drain grate filter assembly 20 comprises the combination of a filter sheet member 21, wedging anchors 30 and mechanical fasteners 32. The filter assembly 20 is used in combination with a drain grate or storm grate 11, shown in the drawing as a storm grate 11 retained within a grate receptacle 13 installed in a ground surface 12, such as a roadway, parking lot or the like. The storm grate 11 has multiple apertures 14 that allow water to pass through the grate 11 but prevent large objects from falling into the drain opening. The apertures 14 may be of many shapes, but in a common design the apertures 14 are elongated slots, typically about 1.25 to 2.5 inches wide.

The filter sheet member 21 may comprise any of the well known durable materials known in the art to be suitable for storm water filtering, such as for example a fine mesh polypropylene monofilament woven fabric, whereby silt and other debris contained in the water is precluded from entering the drain system. The filter sheet member 21 may also be a non-woven felt, a perforated member, etc. The filter sheet member 21 is preferably relatively flexible and thin so as to be easily handled and so as to present a relatively low profile when in use. Most preferably, the filter sheet member 21 is structured so that it can be sized on site using a knife or scissors to properly fit the drain grate 11 so as to cover all the apertures 14. In this manner, the filter assembly 20 can be manufactured in one relatively large size or in only a few sizes without the need to expressly match the dimensions of any particular drain grate 11.

Figure 6:
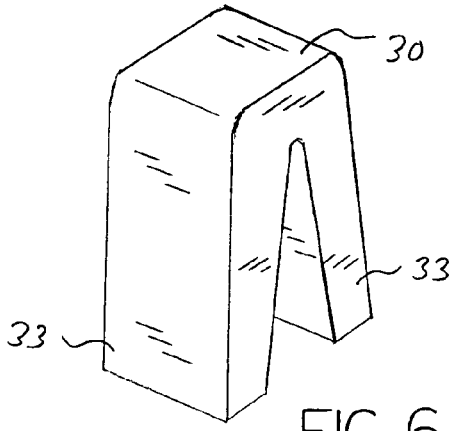
FIGS. 6 and 7 show possible alternative structures for the wedging anchors, wherein the wedging anchors are spring clips.
Figure 7:
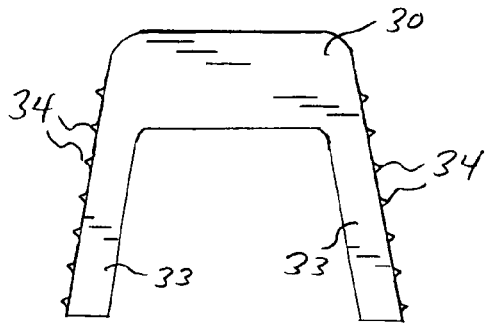

The filter assembly 20 further comprises wedging anchors 30 structured to be inserted into the apertures 14 of the storm grate 11. The wedging anchors 30 are compressible or flexible such that insertion into the apertures 14 results in the wedging anchors 30 being retained snuggly in the apertures 14, the lateral expansive forces acting to prevent vertical movement of the wedging anchors 30. The wedging anchors 30 are composed of a material that is able to receive and retain mechanical fasteners 32, such as for example a closed cell polypropylene foam. The wedging anchors 30 may be of various shapes, such as those shown in FIGS. 3 through 5, whereby the entire body is compressed during insertion. Alternatively, the wedging anchors 30 may be structured as spring clips with leg extensions 33, as shown in FIGS. 6 and 7, the leg extensions 33 being pressed together upon insertion into the grate apertures 14. As shown in FIG. 7, exterior gripping members 34, such as protrusions, ridges, abrasive particles or the like, may be provided to increase traction between the wedging anchor 30 and the sides of the grate aperture 14. Multiple wedging anchors 30 may be joined by string, line or other tether members 15 to preclude loss of the anchors 30.

The mechanical fasteners 32 of the filter assembly 20 comprise pins, staples, U-shaped brads, nails, tacks, or like structures that are capable of being pressed through the filter sheet member 21 and into the wedging anchors 30. For fasteners 32 having no heads or flange portions, it is preferable to include backer members 31 in the filter assembly 20, the backer members 31 being relatively rigid and thin members that are disposed on the surface of the filter sheet member 21, such that the fastener 32 is passed first through the backer member 31, then through the sheet filter member 21 and into the wedging anchor disposed in the grate aperture 14. The backer members 31 may be provided with apertures to receive the mechanical fasteners 32, or may simply be composed of a material of suitable characteristics such that the fasteners 32 may be pressed through the backer members 31. A corrugated plastic construction for the backer members 32 has been found suitable for this result.

To apply the filter assembly 20 to the storm grate 11, one or more wedging anchors 30 are pressed into some of the apertures 14 of the storm grate 11, preferably adjacent the corners or edges of the grate 11. The wedging anchors 30 are forced into apertures sufficient distance such that the upper surface of the wedging anchor 30 is flush with the upper surface of the grate 11. The filter sheet member 21 is then laid upon the storm grate 11, and any excess material extending beyond the perimeter of the grate 11 is removed if desired. If needed, the backer members 32 are then placed on top of the filet sheet member 21 at positions directly above the wedging anchors 30. The fasteners 32 are then inserted through the backer members 32, if present, through the filter sheet member 21 and into the wedging anchors 30. In this manner the filter assembly 20 is securely attached to the storm grate 11, yet may be easily removed when necessary.

In many instances storm grates 11 are used in conjunction with curb inlets. An alternative embodiment for the filter assembly 20 is shown in FIG. 2, wherein an filter flap 22 is joined to the filter sheet member 21, which may be just a continuation of the filter sheet member 21 over all or part of one edge. Inlet retentions means 23, such as a telescoping rod, is provided to retain the inlet filter flap 22 in a generally vertical disposition within the curb inlet, such structures being known in the art. In this manner water flow through either the storm grate 11 or the curb inlet is properly filtered by the filter assembly 20.

In another alternative embodiment, also shown in FIG. 2, the filter assembly 20 further comprises a relief port or opening 24 disposed in the interior of the filter sheet member 21. The relief opening 24 is surrounded by a dam or berm member 25 that rises a short distance above the surface of the filter sheet member 21. In the event that the filter sheet member 21 becomes occluded due to the buildup of silt or debris, or in the event a major storm event produces excessively large amounts of water flow which cannot be passed quickly through the filter sheet member 21, water is able to pass through the relief opening 24 and into the drain system once the backup of water exceeds the height of the berm member 25. Such structures are known in the industry.

It is contemplated that equivalents and substitutions for certain elements set forth above may be obvious to those skilled in the art, and therefore the true scope and definition of the invention is to be as set forth in the following claims.

We claim:

1. A method of mounting a storm grate filter onto a storm drain grate comprising the steps of:

providing a storm grate filter assembly comprising wedging anchors, a filter sheet member and fasteners;

forcing said wedge anchors into apertures in a storm grate;

positioning said filter sheet member on said storm grate; and inserting said fasteners through said filter sheet member and into said wedging anchors.

2. The method of claim 1, further comprising the steps of;

providing backer members;

positioning said backer members on said filter sheet member above said wedging anchors prior to insertion of said fasteners, whereby said fasteners are inserted through said backer members prior to penetration of said filter sheet member.

3. The method of claim 1, further comprising the step of:

cutting said filter sheet member to correspond to the size of the storm grate.

4. The method of claim 1, further comprising the steps of:

providing an inlet filter flap having inlet retention means; and mounting said inlet filter flap inside a curb inlet adjacent said storm grate.

* * * * *